United States Patent [19]

Alberts

[11] Patent Number: 4,719,773

[45] Date of Patent: Jan. 19, 1988

[54] SECUREMENT APPARATUS

[76] Inventor: Scott Alberts, 307 N. Lima St., Burbank, Calif. 91504

[21] Appl. No.: 44,821

[22] Filed: May 1, 1987

[51] Int. Cl.[4] ..... E05B 73/00

[52] U.S. Cl. ..... 70/18; 70/38 B; 70/49

[58] Field of Search ..... 70/18, 38 B, 49, 30, 70/38 R, 38 A, 38 C, 16, 14, 15, 17, 260, 19

[56] References Cited

U.S. PATENT DOCUMENTS

| | | | |
|---|---|---|---|
| 2,759,349 | 8/1956 | McKee | 70/16 |
| 3,590,608 | 7/1971 | Smyth | 20/15 |
| 3,636,739 | 1/1972 | Smedley | 70/ |
| 3,855,826 | 12/1974 | Hori | 70/ |
| 4,064,716 | 12/1977 | Shwayder et al. | 70/ |

FOREIGN PATENT DOCUMENTS

| | | | |
|---|---|---|---|
| 515,934 | 12/1920 | France | 70/38 B |
| 895,516 | 4/1944 | France | 70/1 B |

*Primary Examiner*—Robert L. Wolfe

*Attorney, Agent, or Firm*—James E. Brunton

[57] ABSTRACT

A securement apparatus for locking together remotely located objects, as for example locking a boat to a dock clete or a light airplane to a tiedown. The apparatus includes spaced apart locking mechanisms which are interconnected by an elongated connector having a flotation cover over a length of steel cable.

9 Claims, 6 Drawing Figures

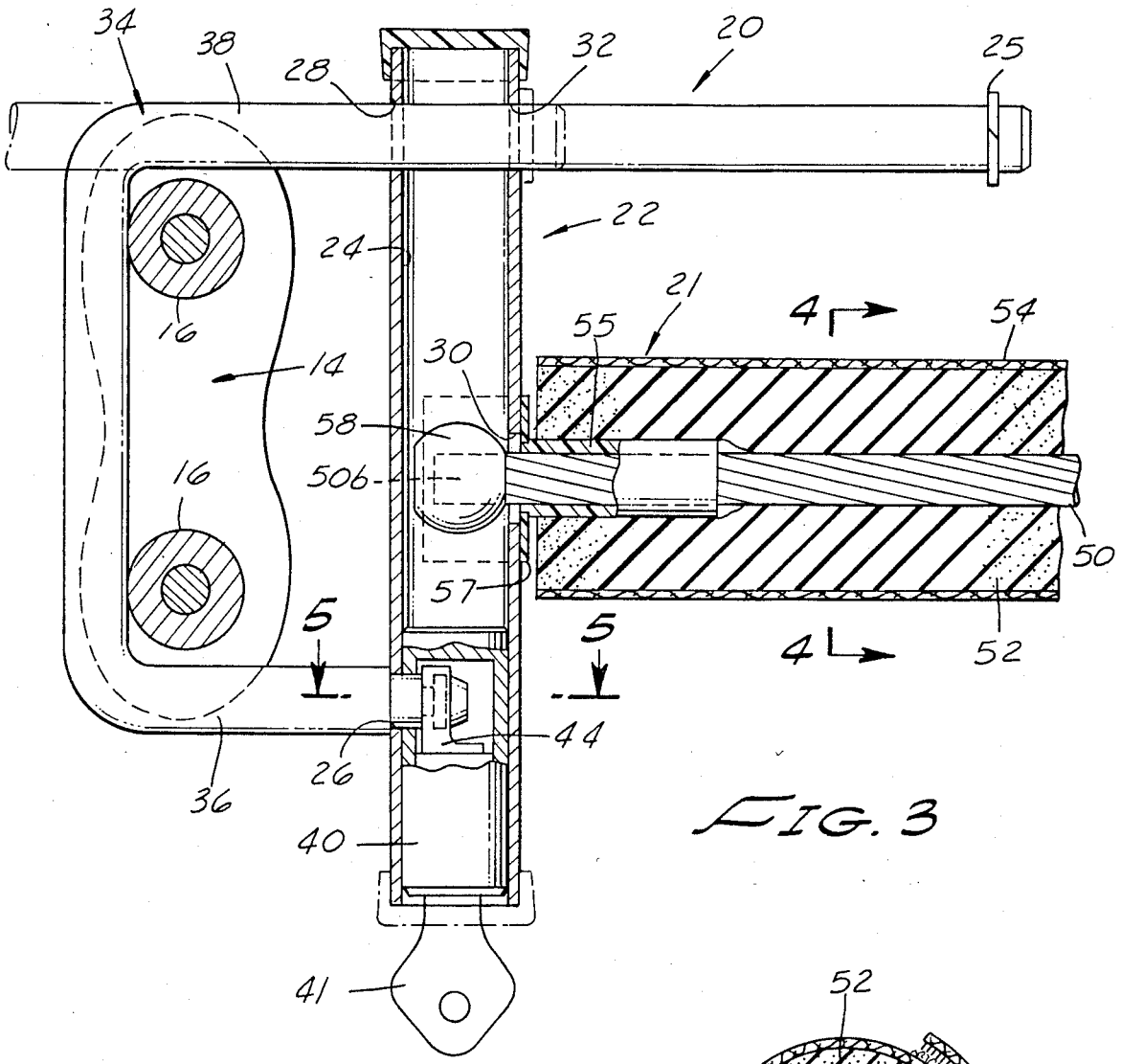
FIG. 3
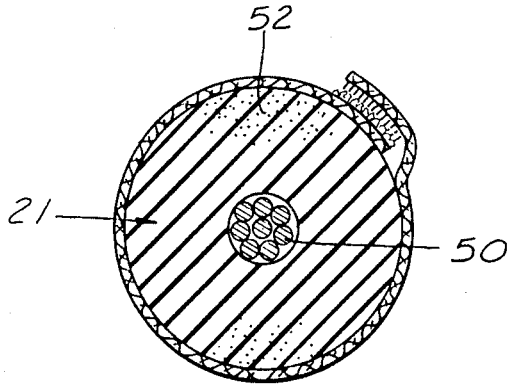
FIG. 4
FIG. 5
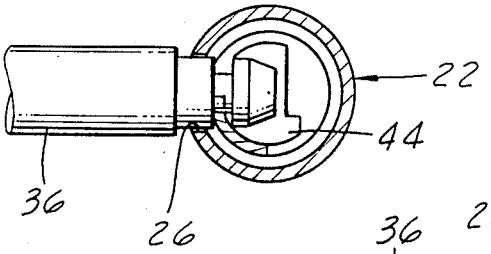
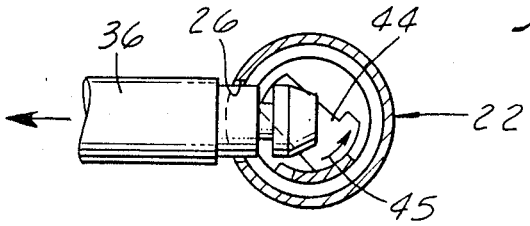
FIG. 6

SECUREMENT APPARATUS

BACKGROUND OF THE INVENTION

1. Field of the Invention

The present invention relates generally to securement devices. More particularly, the invention concerns a device for locking remotely located objects together as, for example, locking a boat to a dock clete or a light airplane to a fixed tiedown.

2. Discussion of the Prior Art

Numerous types of securement devices have been suggested for locking various types of remotely located objects together. Perhaps the most common locking apparatus consists of a length of chain or cable which is passed around the objects to be interlocked and then secured against removal by locking the ends of the cable or chain together with a padlock.

In interlocking certain objects together special problems exist. For example, in locking a boat to a mooring clete, care must be taken that the locking apparatus does scratch, abrade or otherwise damage the boat. Further, for such an application, the locking apparatus must be easy to use and quickly interconnectable both with the clete and with the boat. Additionally, the apparatus should be compact, easy to store and transport and preferably be unsinkable should it be accidentally dropped overboard.

In a similar vein, locking a light airplane to a fixed anchor and securing expensive construction equipment against theft presents other types of special problems. Once again, the apparatus should be constructed in a manner so as not to damage the airplane or the equipment and it must be easy to operate, easy to store and transport, and preferably be of a lightweight construction.

In all instances, the apparatus should be strong, tamperproof and relatively indestructable.

Prior art locking apparatus embodying chains or cables and padlocks are frequently cumbersome and difficult to transport and use. Further, such devices are relatively easy to remove using bolt cutters and the like.

The apparatus of the present invention overcomes the drawbacks of the prior art by providing a securement system which is easy and safe to use and one which meets the special requirements which exist in securing boats, light airplanes, expensive equipment and the like to fixed cletes and tie down members.

SUMMARY OF THE INVENTION

It is an object of the present invention to provide a securement device for use in securing together remotely located objects which includes easy to operate locking shackles affixed at opposite ends of a connector member which member includes a protective covering that will not scratch, abrade or otherwise damage the objects to be secured together.

It is another object of the invention to provide a device of the aforementioned character which can be used to quickly secure a boat to a dock clete.

Another object of the invention is to provide a securement device as described in the preceding paragraph in which the connector member includes a flotation covering so that if the device is accidentally dropped overboard it will not sink.

Still another object of the invention is to provide a securement device of the class described which is compact, easy to store and transport and yet highly durable and difficult to cut or damage.

BRIEF DESCRIPTION OF THE DRAWINGS

FIG. 3 is a view partly in cross-section taken along lines 3—3 of FIG. 2.

FIG. 4 is a cross-sectional view taken along lines 4—4 of FIG. 3 illustrating the construction of the connecting member of the device.

FIG. 5 is a cross-sectional view taken along lines 5—5 of FIG. 3.

FIG. 6 is a cross-sectional view similar to FIG. 5 but showing the locking mechanism moving toward an open, or unlocked position.

DESCRIPTION OF THE INVENTION

Figure 1:
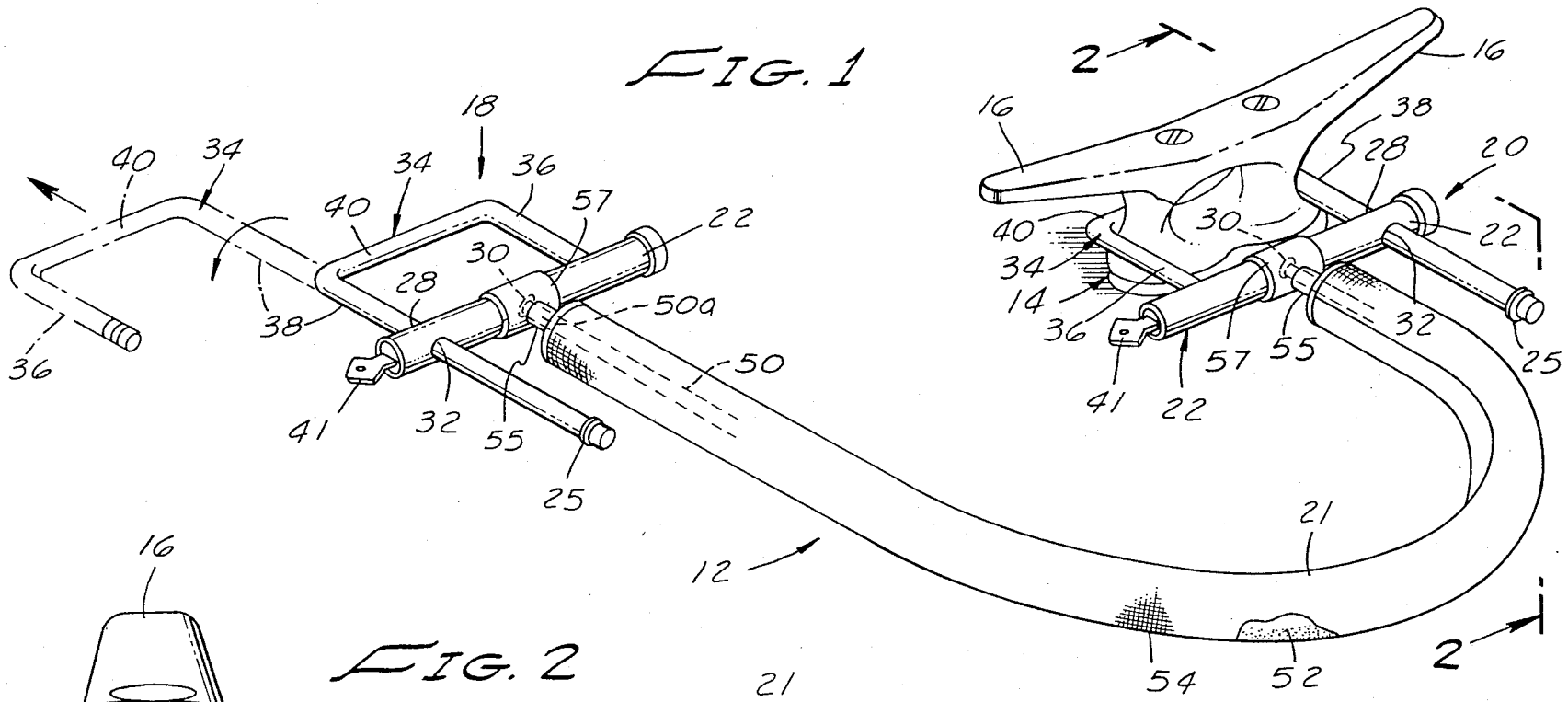
FIG. 1 is a generally perspective view of the locking device of the present invention.
Figure 2:
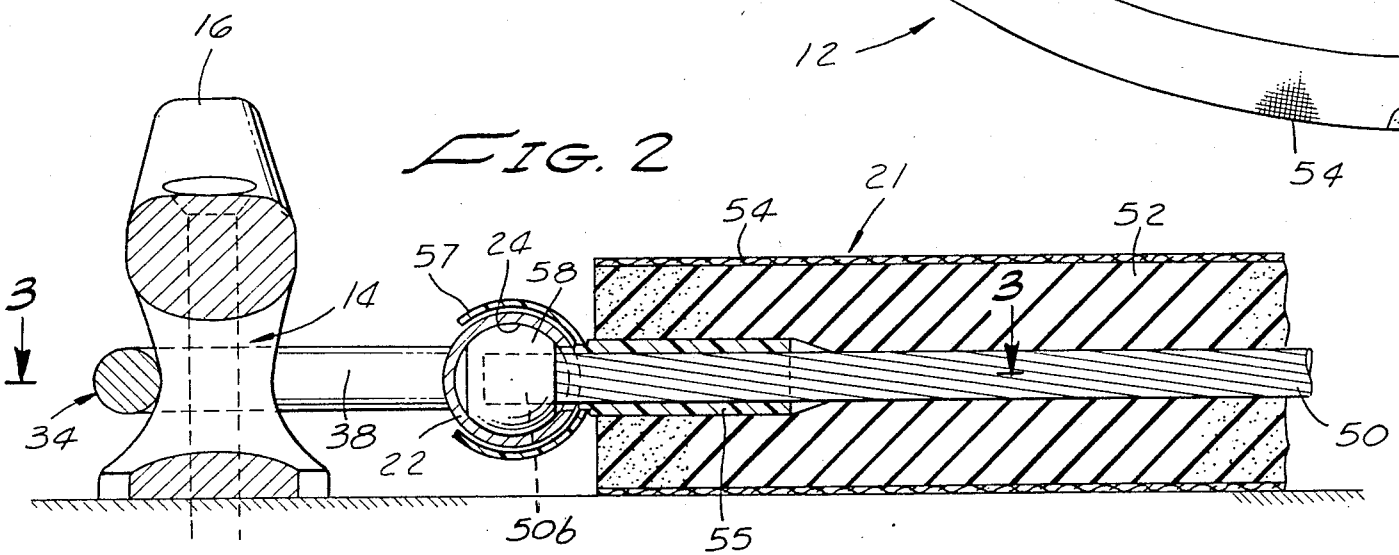
FIG. 2 is a side elevational cross-sectional view taken along lines 2—2 of FIG. 1.

Referring to the drawings, and particularly to FIGS. 1 and 2, the locking device for lockably joining together two spaced apart objects is generally designated by the numeral 12. In the form of the invention shown in the drawings, the locking device is specifically designed for lockably interconnecting a clete on a boat dock with a similarly constructed clete fixed to the boat (not shown). As indicated in FIG. 1 cletes with which the apparatus can be used typically comprise a body portion 14 and a pair of outwardly projecting horns 16.

In the present form of the invention, the locking device comprises first and second securement means generally designated by the numerals 18 and 20 and connector means 21 for interconnecting the first and second securement means. As best seen by referring to FIGS. 1 and 3, each of the securement means comprises a barrel portion 22 having a longitudinally extending bore 24 and first, second, third and fourth spaced apart transverse bores 26, 28, 30 and 32 respectively. The purpose of these transverse bores, each of which is in communication with longitudinally extending bore 24, will presently be discussed.

Also forming a part of each of the first and second securement means is a generally U-shaped shackle 34 which is closely receivable about the spaced apart objects which are to be lockably joined, in this case, the body portions 14 of the cletes mounted on the boat dock and on the boat itself. Each shackle 34 is provided with first and second legs 36 and 38 which are interconnected by a bight portion 40. First and second legs 36 and 38 are closely receivable within transverse bores 26 and 28 of the barrel 22 of the securement means (FIG. 3). As indicated by the phantom lines in FIG. 1, the first and second leg portions of each of the shackles are movable from a first locked position shown by the solid lines in FIG. 1, to a second unlocked, or open position, shown by the phantom lines in FIG. 1.

To lock the first and second legs of each of the shackles in a first position, locking means are here provided in the form of a key operated lock generally designated in FIG. 3 by the numeral 40. Locks 40 are of a character which are readily commercially available and of a construction well known to those skilled in the art. Because the locking mechanism itself forms no part of the present invention, and because various types of locking mechanisms can be used, the details of the construction thereof will not be described herein. Suffice to say that the locking mechanism 40 can be operated by the key 41 to move a locking arm 44 from the locked position shown in FIG. 5 toward an unlocked position in the manner shown in FIG. 6 by the directional arrow 45. When the locking mechanism 40 is moved into the unlocked position, the first leg 36 of the securement means may be withdrawn from transverse bore 26 and the shackle moved telescopically and rotated relative to barrel 24 in the manner shown by the phantom lines in FIG. 1. A split ring 25 is provided proximate the end of leg 38 to prevent its removal from the barrel portion 22.

With the shackle in the open position it is apparent that it can quickly be withdrawn from the clete so that the locking apparatus can be disconnected therefrom. To interlock the apparatus with the anchoring clete, the legs of the shackle are positioned about the body portion 14 of the clete and the shackle telescopically moved into the locking position indicated in the right hand portion of FIG. 1 and in FIG. 3. Due to the simplicity of the design of the locking means of the present invention, the boat can be quickly and easily secured to the dock with a minimum of lost motion and with a maximum of efficiency.

To interconnect the first and second securement means 18 and 20, the previously identified connector means 21 is provided. In the embodiment of the invention shown in the drawings, the connector means takes the form of an elongated connector assembly which includes a centrally disposed, elongated flexible steel cable 50 (FIG. 4) which is surrounded by a flotation sleeve 52 constructed from a floating material, such as foam rubber, foam plastic, or the like. For further protection of the boat, the sleeve 52 is covered by an outer covering 54 which may be any type of suitable non-abrasive vinyl or other plastic material. The flotation sleeve 52 and the covering 54 not only prevent damage to the boat but also tend to protect against cutting at cable 50 with both cutters or the like.

Referring once again to FIGS. 1 and 3, cable 50 is provided with first and second ends **50*a* and 50*b*. First end 50*a* of cable 50 is closely receivable within third transverse bore 30 provided in first securement means 18. Second end 50*b* of cable 50 is closely receivable within third transverse bore 30 provided in second securement means 20 (FIG. 3). A first means is receivable within the longitudinal bore 24 of the first securement means 18 and an identical second means is receivable within the longitudinally extending bore 24 of the second securement means. The first means is fixedly interconnected with the first end of cable 50 while the second means is fixedly interconnected with the second end 50*b* of cable 50. The purpose of the first and second means is to prevent removal of the first and second ends of the cable 50 from the first and second securement means 18 and 20. In the embodiment of the invention shown in the drawings, the first and second means comprise a generally spherically shaped members 58 (FIG. 3) which members are fixedly interconnected with the ends of the cable 50 by any suitable means such as swedging, clamping, bonding or through the use of locking pins. As best seen in FIG. 3, the spherical members 58 are of a diameter greater than the diameter of third transverse bore 30 so that a force exerted on the cable tending to separate it from the securement means will be positively resisted by the spherically shaped member moving into engagement with the barrel portion 22. By locating the third transverse bore 30 generally centrally of the barrel portion 22, an outward force exerted on the cable will result in an even loading being placed on legs 36 and 38 of the shackle which is lockably positioned about the body portion 14 of the clete. As best seen in FIG. 2, stub sleeves 55, surround the ends of cable 50. Sleeves 55 are interconnected at one end to generally tubular shaped partial sleeves 57 which surround barrel portion 22 proximate apertures 30. Stub sleeves 55 along with partial sleeves 57 cover the cable ends and trim out the juncture point of the cable 50 and the barrel portions 22**.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A locking device for lockably joining two spaced apart objects, comprising:

(a) first and second securement means, each said securement means including:

(i) a barrel portion having a longitudinally extending bore and at least first, second and third spaced apart transverse bores in communication with said longitudinally extending bore;

(ii) a generally U-shaped shackle receivable about at least a portion of the spaced apart objects, said shackle having first and second legs movable respectively within said first and second transverse bores of said barrel portion between first and second positions; and (iii) locking means for locking said first and second legs of said shackle in a first position; and (b) connector means for interconnecting said first and second securement means, comprising:

(i) an elongated connector member having first and second ends, said first end being receivable within said third transverse bore of said first securement means and second end being receivable within said third transverse bore of said second securement means;

(ii) first means receivable within said longitudinally extending bore of said first securement means, said first means being connected to said first end of said connector member and being so constructed and arranged as to prevent removal thereof from said longitudinally extending bore of said first securement means; and (iii) second means receivable within said longitudinally extending bore of said second securement means, said second means being connected to said second end of said connector member and being so constructed and arranged as to prevent removal thereof from said longitudinally extending bore of said second securement means.

2. A locking device as defined in claim 1 in which said elongated connector member comprises a length of flexible cable having first and second ends and surrounded by a sleeve constructed from a substantially non-abrasive material.

3. A locking device as defined in claim 2 in which said sleeve is constructed at least in part from a flotation material of a character which will cause said connector member to float proximate the surface of a body of water.

4. A locking device as defined in claim 2 in which said first and second means each comprise a generally spherically shaped member connected to said first and second ends respectively of said cable, said spherically shaped members being larger in diameter than the diameter of said third transverse bores formed in said barrel portions of said first and second securement means.

5. A locking device as defined in claim 4 in which said third transverse bores are disposed generally centrally of said barrel portions of said first and second securement means.

6. A locking device as defined in claim 5 in which said barrel portion is provided with a fourth transverse bore axially aligned with said second transverse bore and in which said second leg of said shackle is rotationally and telescopically movable within said second and fourth transverse bores.

7. A locking device as defined in claim 6 in which said first leg of said shackle is telescopically movable within said first transverse bore and is removable therefrom when said legs are moved into said second position.

8. A locking device for lockably joining a clete on a boat of the character having a body portion and outwardly projecting horns and a clete on a dock of the character having a body portion and outwardly projecting horns to secure the boat against theft, said locking device comprising:

(a) first and second securement means, each said securement means including:

(i) a barrel portion having a longitudinally extending bore and at least first, second and third spaced apart transverse bores in communication with said longitudinally extending bore;

(ii) a generally U-shaped shackle receivable about the body portions of the cletes and beneath the outwardly projecting horns, said shackle having first and second legs movable respectively within said first and second transverse bores of said barrel portion between first and second positions; and (iii) locking means for locking said first and second legs of said shackle in a first position; and (b) connector means for interconnecting said first and second securement means, comprising:

(i) an elongated connector member including a flexible cable having first and second ends and a flotation sleeve surrounding said flexible cable, said first end being receivable within said third transverse bore of said first securement means and said second end being receivable within said third transverse bore of said second securement means;

(ii) first means receivable within said longitudinally extending bore of said first securement means, said first means being connected to said first end of said connector member and being so constructed and arranged as to prevent removal thereof from said longitudinally extending bore of said first securement means; and (iii) second means receivable within said longitudinally extending bore of said second securement means, said second means being connected to said second end of said connector member and being so constructed and arranged as to prevent removal thereof from said longitudinally extending bore of said second securement means.

9. A locking device as defined in claim 8 in which said first and second means each comprise a generally spherically shaped member connected to said first and second ends respectively of said cable, said spherically shaped members being larger in diameter than the diameter of said third transverse bores formed in said barrel portions of said first and second securement means.

* * * * *